US006104348A

United States Patent [19]

Karlsson et al.

[11] Patent Number: 6,104,348

[45] Date of Patent: Aug. 15, 2000

[54] ANTENNA DEVICE WITH IMPROVED CHANNEL ISOLATION

[75] Inventors: Jan-Erik Karlsson, Rimbo; Stefan Jonsson, Stocksund, both of Sweden

[73] Assignee: Allgon AB, Åkersberga, Sweden

[21] Appl. No.: 09/120,885

[22] Filed: Jul. 23, 1998

[30] Foreign Application Priority Data

Jul. 23, 1997 [SE] Sweden ..... 9702786

[51] Int. Cl.[7] ..... H01Q 3/02; H01Q 21/12; H01Q 19/10; H01Q 19/00

[52] U.S. Cl. ..... 343/700 MS; 343/815; 343/818; 343/833; 343/834

[58] Field of Search ..... 343/700 MS, 815, 343/817, 818, 833, 834

[56] References Cited

U.S. PATENT DOCUMENTS

| | | | |
|---|---|---|---|
| 2,897,497 | 7/1959 | Finneburgh | 343/819 |
| 4,812,855 | 3/1989 | Coe et al. | 343/815 |
| 5,300,936 | 4/1994 | Izadian | 343/700 MS |

*Primary Examiner*—Hoanganh Le
*Assistant Examiner*—Jennifer H. Malos
*Attorney, Agent, or Firm*—Jacobson, Price, Holman & Stern, PLLC

[57] ABSTRACT

An antenna device for receiving and/or transmitting dual polarized electromagnetic waves, comprising at least one antenna element (7). There are disposed parasitic elements (8, 9) of an electrically conductive material in a region, which surrounds the antenna element and includes the space between and including two parallel planes (2, 1) being defined by a ground plane layer (2) and the antenna element (7), respectively. Each parasitic element (8, 9) comprises at least one elongated, longitudinal portion, extending along an associated lateral side of the antenna element.

21 Claims, 4 Drawing Sheets

ANTENNA DEVICE WITH IMPROVED CHANNEL ISOLATION

BACKGROUND OF THE INVENTION

1. Field of the Invention

The present invention relates to an antenna device for receiving and/or transmitting dual polarized electromagnetic waves, comprising at least one antenna element located at a distance from a ground plane layer of electrically conducting material, and a feed network having two feed elements being adapted to transfer said electromagnetic waves from and/or to said antenna element.

2. Description of the Related Art

Such antennas are used i.a. for the transfer of microwave carriers in telecommunication systems, in particular in base stations for cellular mobile telephones. The capacity of the system is improved by the provision of two separate channels, obtained by orthogonal polarization, for each particular frequency or frequency band. However, in order to obtain the desired diversity, it is essential that the isolation between the two channels is very good.

In an antenna device disclosed in the pending Swedish patent application 9700401-4, an improved isolation between the two channels has been obtained by arranging, along a longitudinal row of antenna elements, in the vicinity of a gap between a respective pair of adjacent antenna elements, parasitic elements having a longitudinal extension substantially in parallel to the centre line of the row. In this way, the mutual electromagnetic coupling between the adjacent antenna elements, which would deteriorate the isolation has been reduced. Also, the isolation between the two channels within each one of the antenna elements is retained with such an arrangement.

However, a problem has arisen when trying to achieve a wider beam angle, such as 90°, by making the antenna device, and in particular the ground plane layer, more narrow. Then, it has turned out that the isolation between the two channels within each one of the antenna elements becomes insufficient, whereas the isolation between adjacent antenna elements can be retained even without parasitic elements provided that the distance between adjacent antenna elements is large enough.

Attempts have been made to vary the shape of the parasitic elements, but such attempts have failed to give any improvement.

SUMMARY OF THE INVENTION

The object of the present invention is to solve this problem and to provide an antenna device of the kind stated in the first paragraph, wherein the isolation between the two channels is substantially improved.

This object is achieved by the present invention by disposing parasitic elements of an electric conducting material in a region, which surrounds the antenna element at least on two opposite lateral sides thereof and includes the space between and including two parallel planes being defined by the ground plane layer and the antenna element, respectively, each such parasitic element comprising at least one elongated, longitudinal portion extending along an associated one of said opposite lateral sides of the antenna element.

Thus, surprisingly, it has turned out that parasitic elements with such an open or frame-like structure will give an excellent result. In fact, by such a measure, an isolation improvement of 13–20 dB has been achieved.

Suitable embodiments and further improvements are stated in the dependent claims and will be apparent from the detailed description below.

BRIEF DESCRIPTION OF THE DRAWINGS

Thus, the invention will now be described more fully with reference to the appended drawings which illustrate two preferred embodiments.

On the drawings, only those parts which are essential to the present invention are shown. Other structural parts and details have been left out for the sake of clarity.

DETAILED DESCRIPTION OF THE PREFERRED EMBODIMENTS

Figure 1:
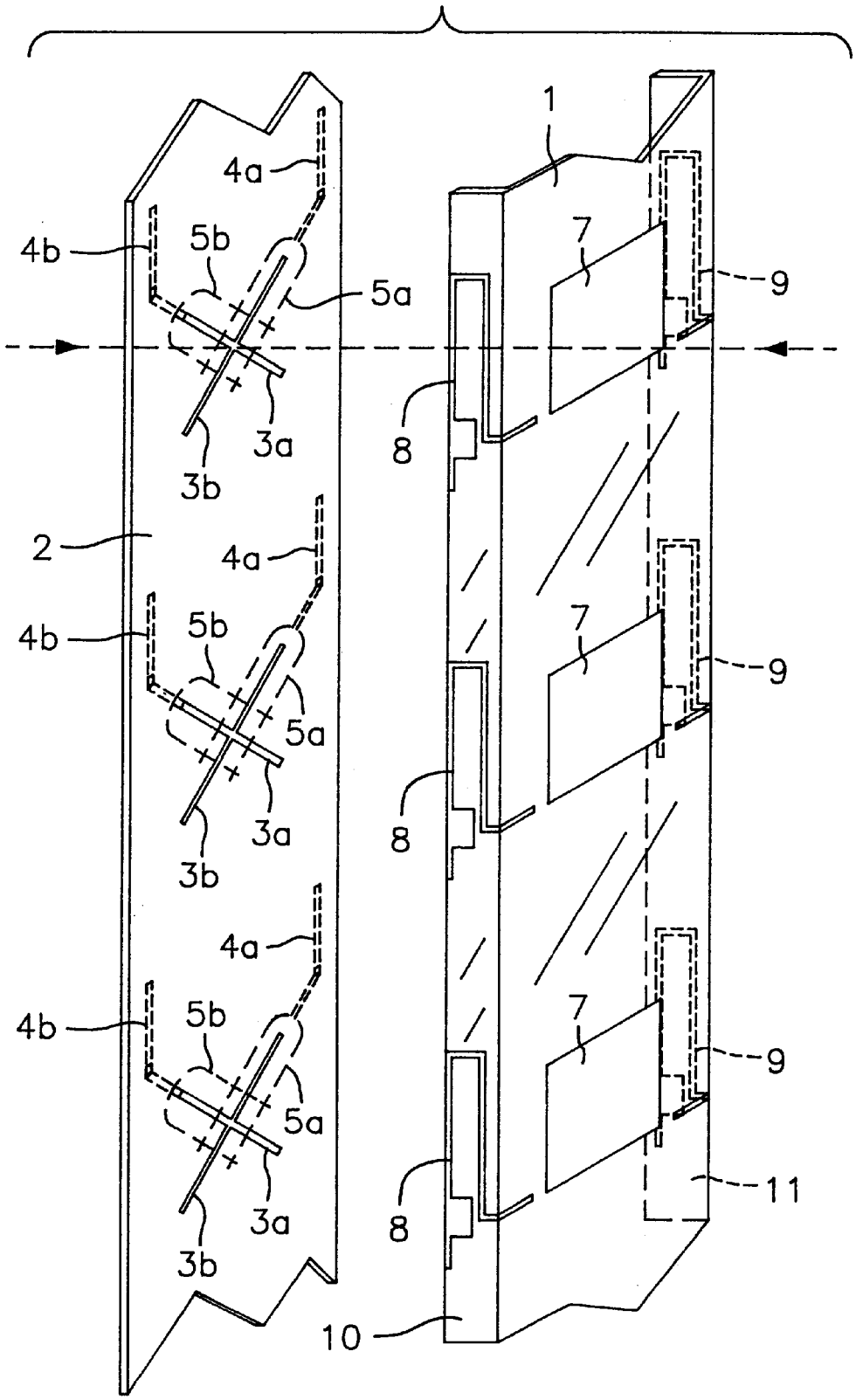
FIG. 1 shows, schematically, in an exploded perspective view, an antenna device according to the present invention.
Figure 2:
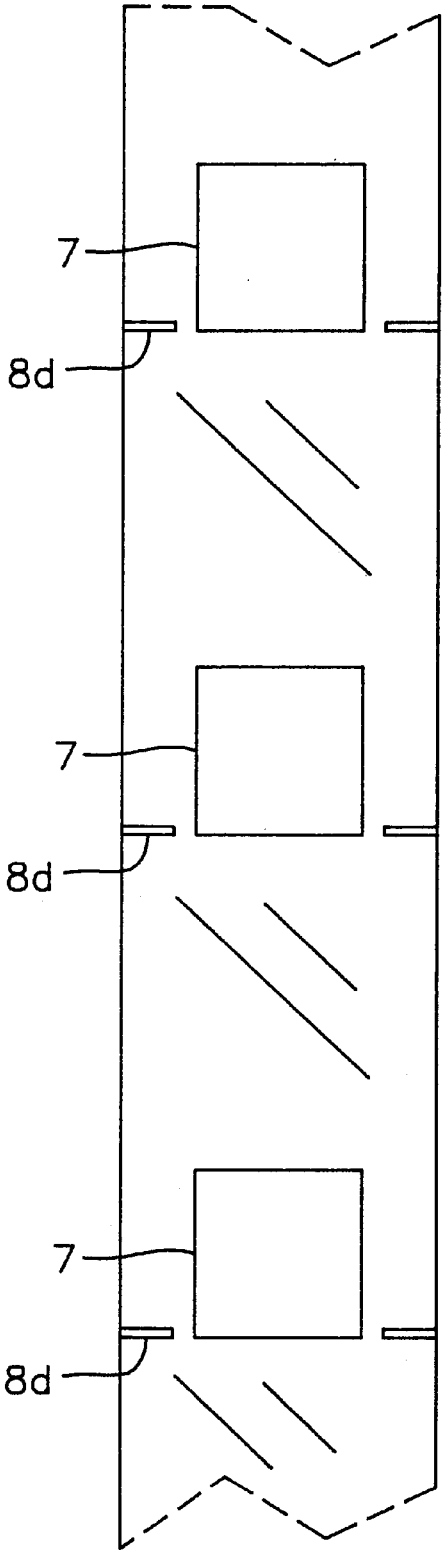
FIG. 2 shows, likewise schematically, a planar view of the antenna device.

With reference to FIG. 1, the antenna device comprises at least two separate dielectric layers, including an upper layer 1 and a lower layer 2. The two layers have the shape of elongated rectangles and are disposed in parallel but at a mutual distance from each other. On the lower layer 2 (to the left in FIG. 1) there is a ground plane layer (not shown separately) of an electrically conducting material and having a number of cross-shaped apertures 3*a*, 3*b* arranged in a longitudinal row. At the underside of the dielectric layer 2, there is a feeding network including feed lines 4*a*, 4*b* and fork-shaped feed elements 5*a*, 5*b* in the form of microstrip lines, the feed lines 4*a* and the feed elements 5*a* being connected to a first microwave feed channel (not shown) and the feed lines 4*b* and the feed elements 5*b* being connected to a second microwave feed channel (not shown).

The cross-shaped apertures 3*a*, 3*b* are each located in registry with (though rotated 45° relative to) an associated radiating patch 7 on the upper or front layer 1. The patches 7 each have a square configuration and are disposed in a row along a centre line at regular distances from each other.

The patches 7 are fed from the two feed channels so as to radiate a microwave beam having dual polarization. Of course, the two channels should be electrically isolated from each other.

According to the present invention, the isolation between the two channels is substantially improved by means of parasitic elements 8, 9 disposed on opposite lateral sides of each antenna element 7. The parasitic elements 8, 9 are made of an electric conducting material. In the embodiments shown in FIGS. 1–5, they are located on dielectric side walls 10, 11, which are integrated in one piece with the upper or front layer 1.

Accordingly, the parasitic elements 8, 9 are located substantially in a region between two parallel planes being defined by the ground plane layer (at the dielectric layer 2) and the planar radiating patches 7, respectively.

As will be apparent also from FIGS. 2–5, the oppositely located parasitic elements are each made of an electrically conductive strip material configured as an open structure, i.e. a structure which is partially open or hollow (in contrast to a solid or homogeneous structure).

The open structure includes at least one elongated portion extending substantially in parallel to an associated one of the antenna elements or patches. The open structure may comprise one or more loops, open or closed, and possible other portions.

Figure 3:
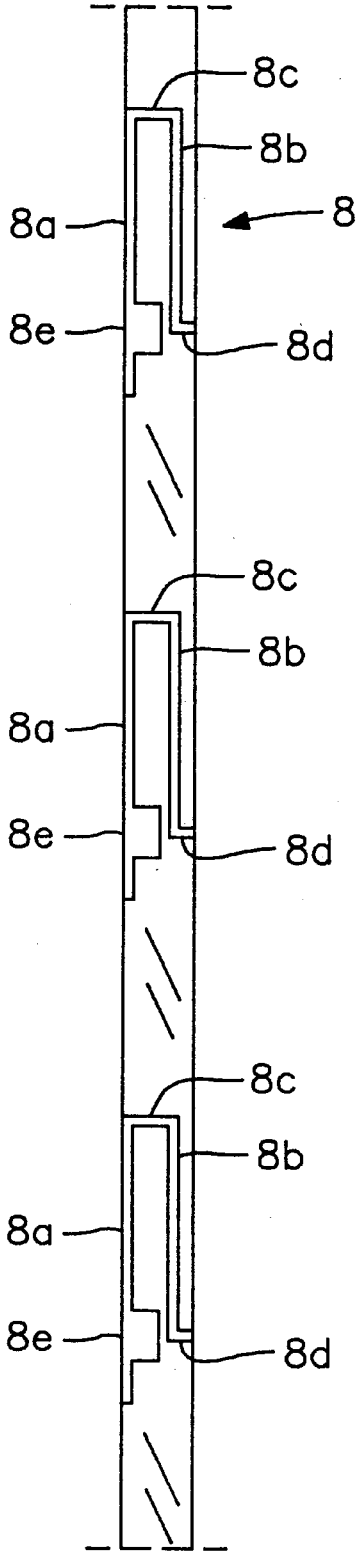
FIG. 3 shows, likewise schematically, a side view of the antenna device.

With reference to FIG. 3, the element 8 includes a meander-like open loop having a relatively long lower leg 8*a* and an upper, somewhat shorter leg 8*b*, which is parallel to the lower leg 8*a*, and a short connecting leg 8*c*. At the free end of the upper leg 8*b*, there is a transversal, relatively short leg 8*d* extending on the upper layer 1 towards the radiating patch 7.

The two longer legs 8*a* and 8*b* are located in a plane 10 which is perpendicular to the two parallel planes of the layers 1 and 2. Moreover, these longer legs 8*a* and 8*b* are located substantially in or in close proximity to a respective one of these two parallel planes.

Adjacent to its free end, the longer, lower leg 8*a* has an enlarged portion 8*e*, which is substantially rectangular and located in registry with the transversely extending leg 8*d*. The enlarged portion 8*e* leaves a small gap to the opposite, shorter leg 8*b*, the gap being substantially smaller than the mutual distance between the two legs 8*a*, 8*b*. Thus, there will be a capacitive coupling between the enlarged portion 8*e* and the leg 8*b*.

Figure 4:
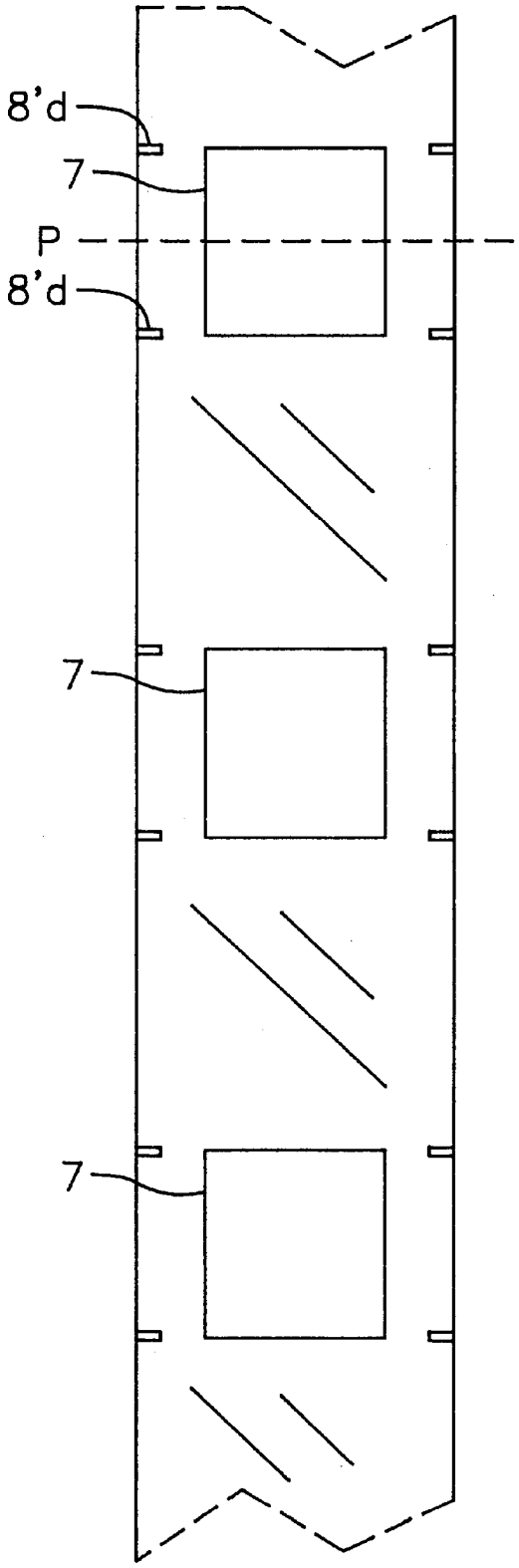
FIGS. 4 and 5 are views similar to those of FIGS. 2 and 3, respectively, of a second embodiment of the antenna device according to the invention.
Figure 5:
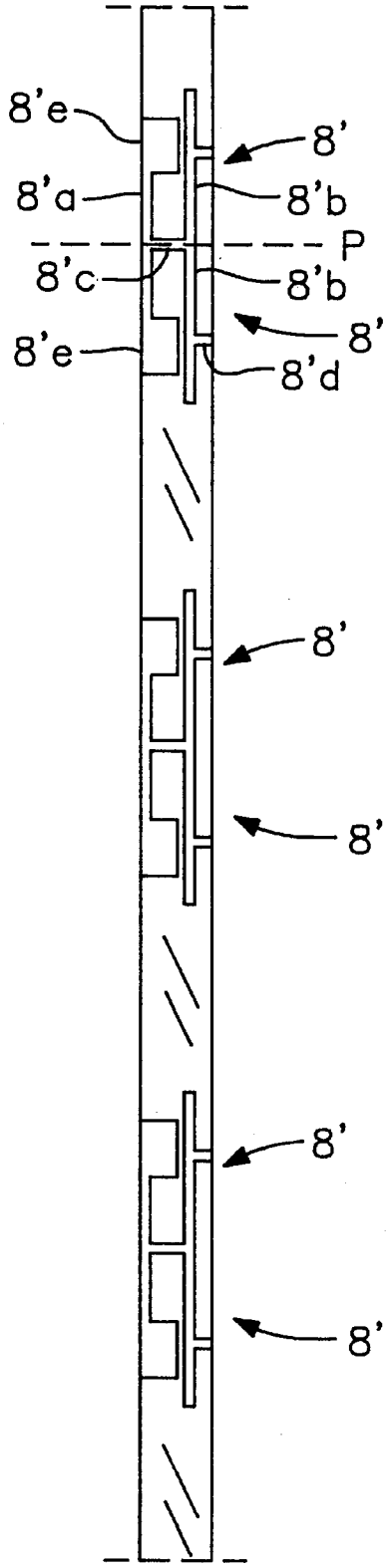

In the second embodiment shown in FIGS. 4 and 5, each parasitic element 8' is substantially symmetrical with reference to a transversal plane P through the centre of the associated antenna element 7 (perpendicular to the layers 1 and 2 in FIG. 1). Thus, the parasitic element comprises two symmetrically configured open loops 8', one being a mirror of the other, each including a lower leg 8'*a*, an upper leg 8'*b*, which is parallel to the lower leg 8'*a*, a central connecting leg 8'*c* (in common to the two loops 8'), a transversal, relatively short leg 8'*d* extending on the upper layer towards the radiating patch 7, and an enlarged portion 8'*e* on the lower leg 8'*a*. Thanks to the symmetrical configuration relative to each associated patch, the overall radiation pattern will be more uniform than in the previous embodiment.

Some further embodiments of the parasitic elements surrounding a patch 7 are illustrated in FIGS. 6 through 11, it being assumed that the antenna device has the general structure shown in FIG. 1 (except for the particular parasitic elements).

Figure 6:
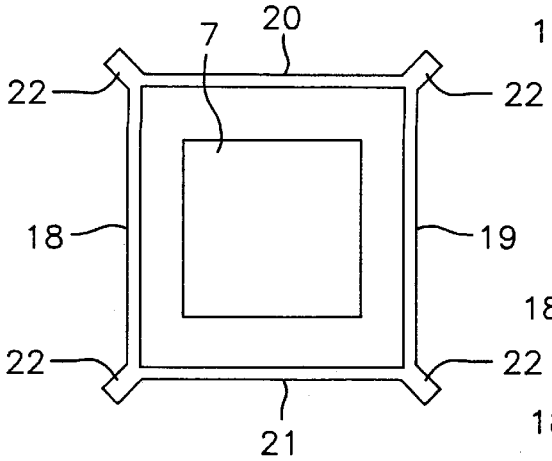
FIGS. 6 through 11 illustrate schematically, in planar views, some further embodiments of the antenna device.

In FIG. 6, the patch 7 is surrounded by a closed, rectangular or square frame which constitutes the parasitic elements, including elongated, longitudinal portions 18, 19 and elongated, transverse portions 20, 21. There are also enlarged portions 22 projecting outwardly from the four corners.

Figure 7:
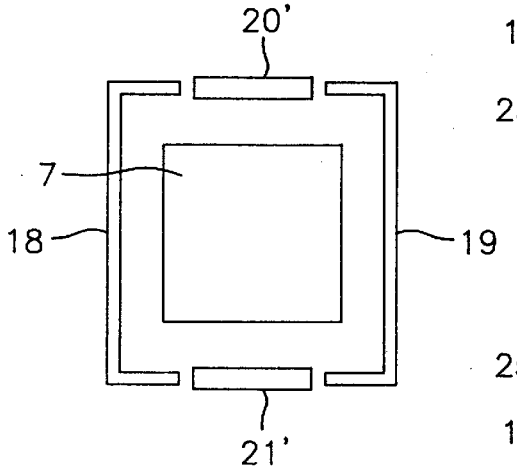

The parasitic elements shown in FIG. 7 are similar to those of FIG. 6, but the square frame is interrupted at the transverse portions 20', 21', the latter being somewhat wider than the corresponding portions 20, 21 in FIG. 6.

Figure 8:
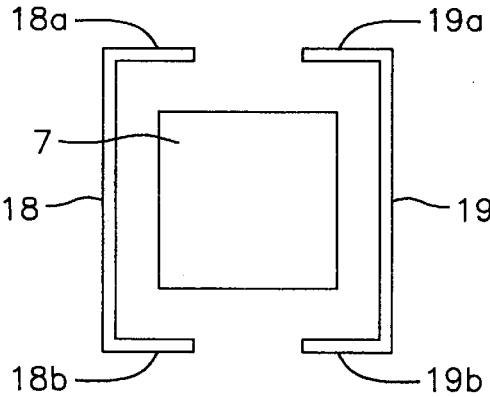

In FIG. 8 the the longitudinal portions 18, 19 merge with relatively short transverse portions 18*a*, 18*b* and 19*a*, 19*b*, respectively.

Figure 9:
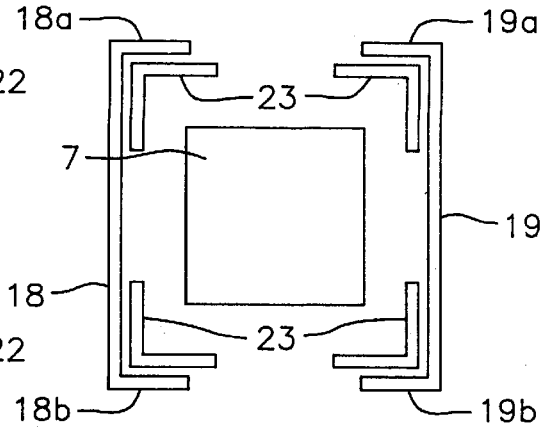
Figure 10:
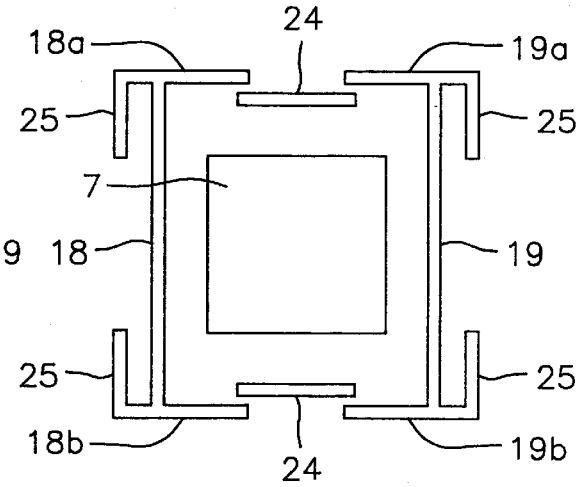
Figure 11:
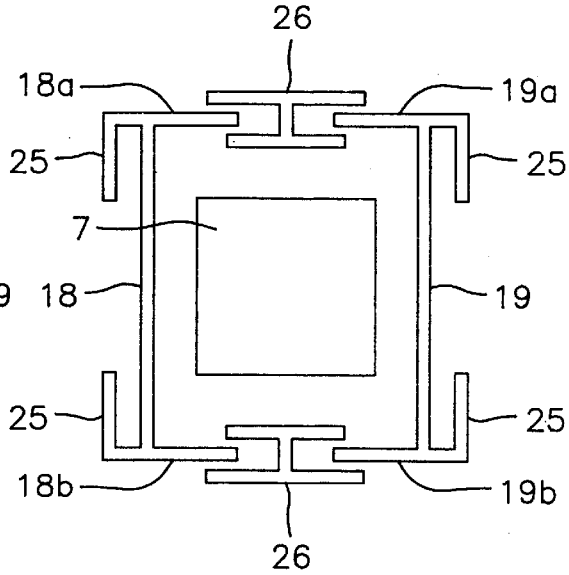

In the modified embodiments shown in FIGS. 9, 10 and 11, the substantially square frame is likewise interrupted at the transverse portions but there are additional elongated portions 23, 24, 25, 26 located closely in parallel to the respective longitudinal and transverse portions.

It should be pointed out that the inventive concept is much broader than the specific embodiments illustrated on the drawings. The antenna device may include a single antenna element, in which case there will be only one pair of parasitic elements on opposite sides of the single antenna element, possibly configured as shown in FIGS. 6 through 11. Each antenna element and the associated feed elements may be different from the shown examples, the important feature of the antenna element being the open or frame-like structure enabling an effective isolation between the two channels within each antenna element. However, in order to maintain the orthogonality between the two channels, the antenna element should be symmetrical and have the same geometry upon being rotated 90°.

The parasitic elements should be made of an electrically conducting material, but it does not have to be formed of a strip. Rather it could be constituted by a wire bent into an open or frame-like structure with two opposite longitudinal portions.

The side walls 10, 11 do not have to be exactly perpendicular to the two layers 1, 2 but may be slightly inclined.

Of course, the present invention can be combined with the arrangement disclosed in the pending Swedish patent application 9700401-4 mentioned above.

Those skilled in the art will be able to modify the antenna device further within the scope of the appended claims.

We claim:

1. An antenna device for receiving and/or transmitting dual polarized electromagnetic waves, comprising at least one antenna element located at a distance from a ground plane layer of electrically conducting material, and a feed network having two feed elements being adapted to transfer said dual polarized electromagnetic waves in two mutually orthogonal channels from and/or to said antenna element, further comprising parasitic elements of an electrically conducting material disposed in a region, the region surrounding said antenna element at least on two opposite lateral sides thereof and includes a space between and including two parallel planes being defined by said ground plane layer and said antenna element, respectively, each such parasitic element comprising at least one elongated, longitudinal portion extending along an associated one of said opposite lateral sides of said antenna element and forming at least a part of a frame-like structure so as to provide an effective isolation between said two mutually orthogonal channels.

2. The antenna device as defined in claim 1, wherein two of said elongated, longitudinal portions are joined by elongated transverse portions so as to form a closed frame structure which surrounds said antenna element.

3. The antenna device as defined in claim 2, wherein said closed frame structure has the shape of a rectangle or a square.

4. The antenna device as defined in claim 3, wherein said parasitic elements comprise enlarged portions at the corners of said rectangle or square.

5. The antenna device as defined in claim 1, wherein two of said elongated portions merge with transverse portions so as to form an interrupted frame structure which surrounds said antenna element.

6. The antenna device as defined in claim 5, wherein said interrupted frame structure has the shape of a rectangle or square.

7. The antenna device as defined in claim 5, wherein said interrupted frame structure includes additional elongated portions located closely in parallel to at least one of said longitudinal portions and/or at least one of said transverse portions.

8. The antenna device as defined in claim 1, wherein said parasitic elements are constituted by a strip material.

9. The antenna device as defined in claim 1, wherein each of said longitudinal portions forms a part of an open structure.

10. The antenna device as defined in claim 9, wherein said open structure comprises at least one loop.

11. The antenna device as defined in claim 10, wherein said at least one loop is open.

12. The antenna device as defined in claim 11, wherein said open structure comprises two symmetrical open loops.

13. The antenna device as defined in claim 12, wherein said two symmetrical open loops extend in opposite directions from a common leg.

14. The antenna device as defined in claim 9, wherein two of said elongated, longitudinal portions are located in close proximity to a respective one of said two parallel planes (2, 1).

15. The antenna device as defined in claim 9, wherein said open structure is located substantially in a plane which is perpendicular to said two parallel planes.

16. The antenna device as defined in claim 9, wherein said open structure comprises a portion extending transversely towards said antenna element.

17. The antenna device as defined in claim 9, wherein at least one of said elongated, longitudinal portions of said open structure is provided with an enlarged portion leaving a gap which is substantially smaller than the mutual distance between the two elongated, longitudinal portions.

18. The antenna device as defined in claim 17, wherein said enlarged portion is substantially rectangular and located in registry with said transversely extending portion.

19. The antenna device as defined in claim 1, wherein said at least one antenna element comprises a row of radiating patches located along a longitudinal axis, wherein said parasitic elements are located pair-wise on each lateral side of said longitudinal axis outside each radiating patch.

20. An antenna device for receiving and/or transmitting dual polarized electromagnetic waves, comprising at least one antenna element located at a distance from a ground plane layer of electrically conducting material, and a feed network having two feed elements being adapted to transfer said dual polarized electromagnetic waves from and/or to said antenna element, further comprising parasitic elements of an electrically conducting material in a region, the region surrounding said antenna element at least on two opposite lateral sides thereof and includes a space between and including two parallel planes being defined by said ground plane layer and said antenna element, respectively, each such parasitic element comprising at least one elongated, longitudinal portion extending along an associated one of said opposite lateral sides of said antenna element wherein two of said elongated, longitudinal portions are joined by elongated transverse portions so as to form a closed frame structure which surrounds said antenna element.

21. An antenna device for receiving and/or transmitting dual polarized electromagnetic waves, comprising at least one antenna element located at a distance from a ground plane layer of electrically conducting material, and a feed network having two feed elements being adapted to transfer said dual polarized electromagnetic waves from and/or to said antenna element, further comprising parasitic elements of an electrically conducting material in a region, the region surrounding said antenna element at least on two opposite lateral sides thereof and includes a space between and including two parallel planes being defined by said ground plane layer and said antenna element, respectively, each such parasitic element comprising at least one elongated, longitudinal portion extending along an associated one of said opposite lateral sides of said antenna element wherein two of said elongated portions merge with transverse portions so as to form an interrupted frame structure which surrounds said antenna element.

* * * * *